US006052944A

United States Patent [19]

Louda

[11] Patent Number: 6,052,944

[45] Date of Patent: Apr. 25, 2000

[54] OBJECT WITH FORWARD AND SUBSEQUENT LATERAL DISPLACEMENT OF FORWARD MOVABLE SURFACES

[75] Inventor: Jan Louda, Prague, Czech Rep.

[73] Assignee: Heinrich Hahn, Czech Rep.

[21] Appl. No.: 09/043,515

[22] PCT Filed: Sep. 23, 1996

[86] PCT No.: PCT/CZ96/00019

§ 371 Date: May 14, 1998

§ 102(e) Date: May 14, 1998

[87] PCT Pub. No.: WO97/13050

PCT Pub. Date: Apr. 10, 1997

[30] Foreign Application Priority Data

Sep. 29, 1995 [CZ] Czech Rep. ..... 2548-95

[51] Int. Cl.[7] ..... E05D 15/10

[52] U.S. Cl. ..... 49/212; 49/216

[58] Field of Search ..... 49/209, 211, 212, 49/216, 217, 218, 219, 221, 222, 223, 224, 225

[56] References Cited

U.S. PATENT DOCUMENTS

| | | | |
|---|---|---|---|
| 2,508,972 | 5/1950 | Shattuck | 212/4 |
| 2,893,071 | 7/1959 | Oden | 20/19 |
| 3,571,976 | 3/1971 | Schmid | 49/212 X |
| 4,112,622 | 9/1978 | Stewart | 49/421 |
| 5,566,505 | 10/1996 | Kamezaki | 49/225 |

FOREIGN PATENT DOCUMENTS

| | | | |
|---|---|---|---|
| 295072 | 12/1971 | Austria . | |
| 339531 | 10/1977 | Austria . | |
| 1149950 | 1/1958 | France . | |
| 2151063 | 4/1973 | Germany | 49/217 |
| 3709309 | 10/1988 | Germany . | |
| 2152567 | 8/1985 | United Kingdom | 49/223 |

*Primary Examiner*—Jerry Redman

*Attorney, Agent, or Firm*—Burns, Doane, Swecker & Mathis, LLP

[57] ABSTRACT

An object with a forward and subsequent lateral displacement of forward movable surfaces includes surfaces which travel forward and then laterally to overlap adjacent surfaces. The object may be a display box, case, furniture, or other object. The object includes mutually forward movable surfaces and at least one load-bearing frame. A part of the frame is a linear compact assembly, which is parallel with the plane of the forward movable surfaces. The linear compact assembly includes a principal structural section with a constant cross-section on its whole length. At least two identical action elements having a constant cross-section along their length are movably seated inside of the principal structural section in a seat. At least two identical forward movable bearing sections, having a constant cross-section along their whole length are firmly connected with forward movable surfaces.

26 Claims, 11 Drawing Sheets

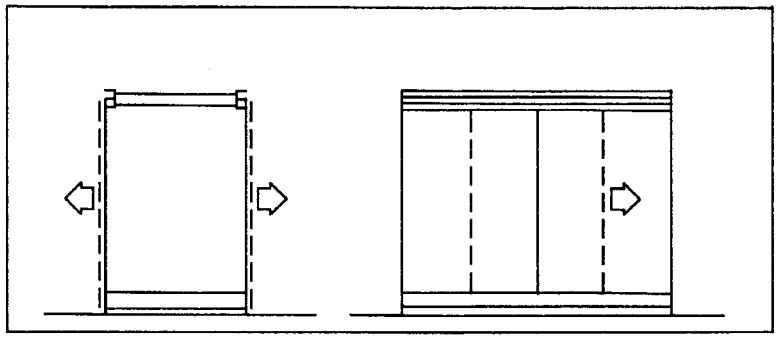
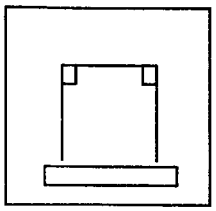
FIG. 5
FIG. 6
FIG. 7
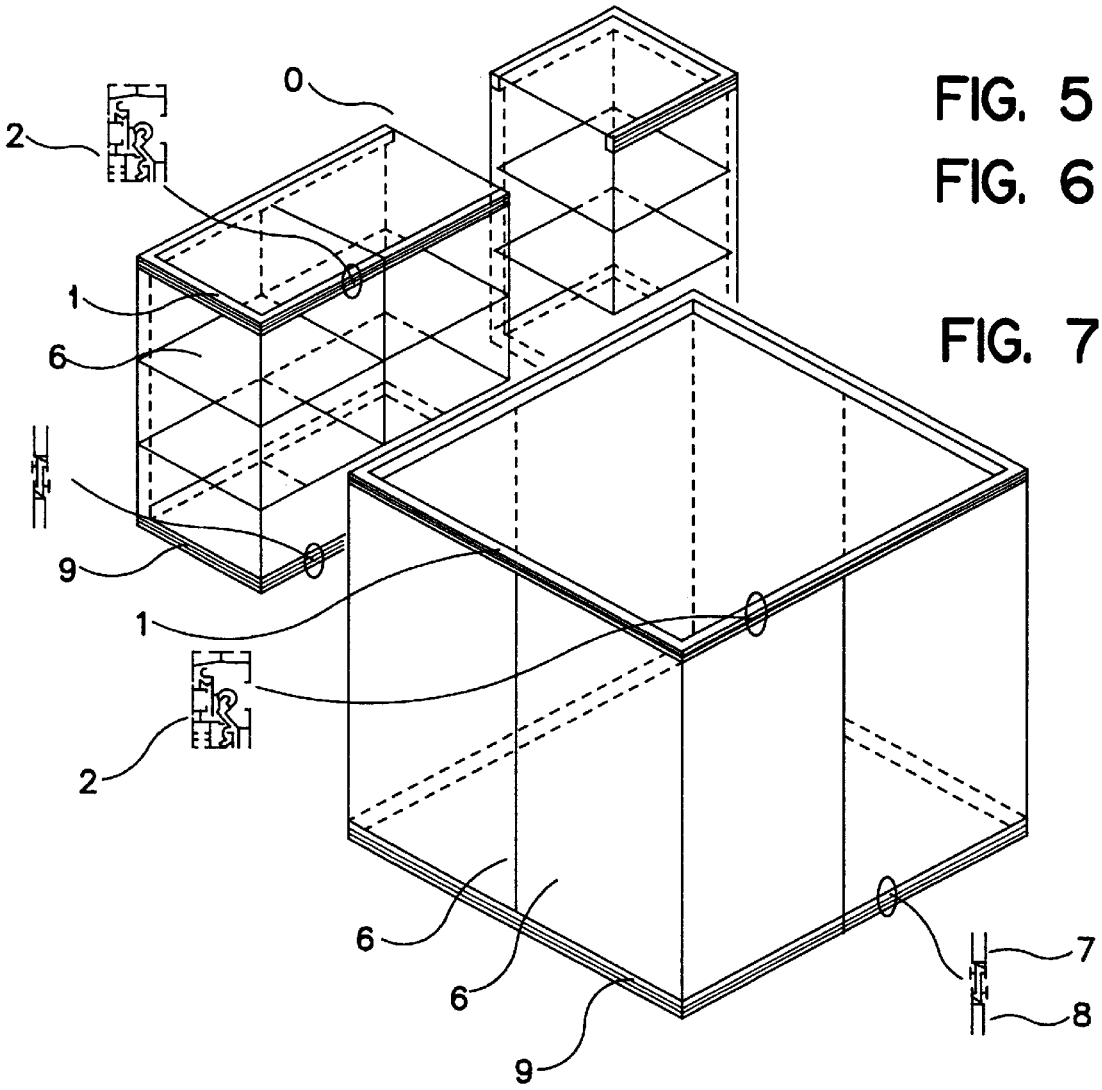

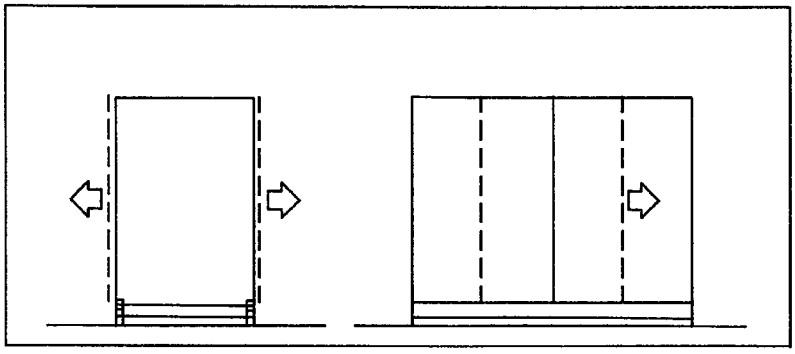
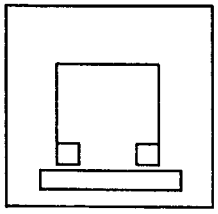
FIG. 9
FIG. 8
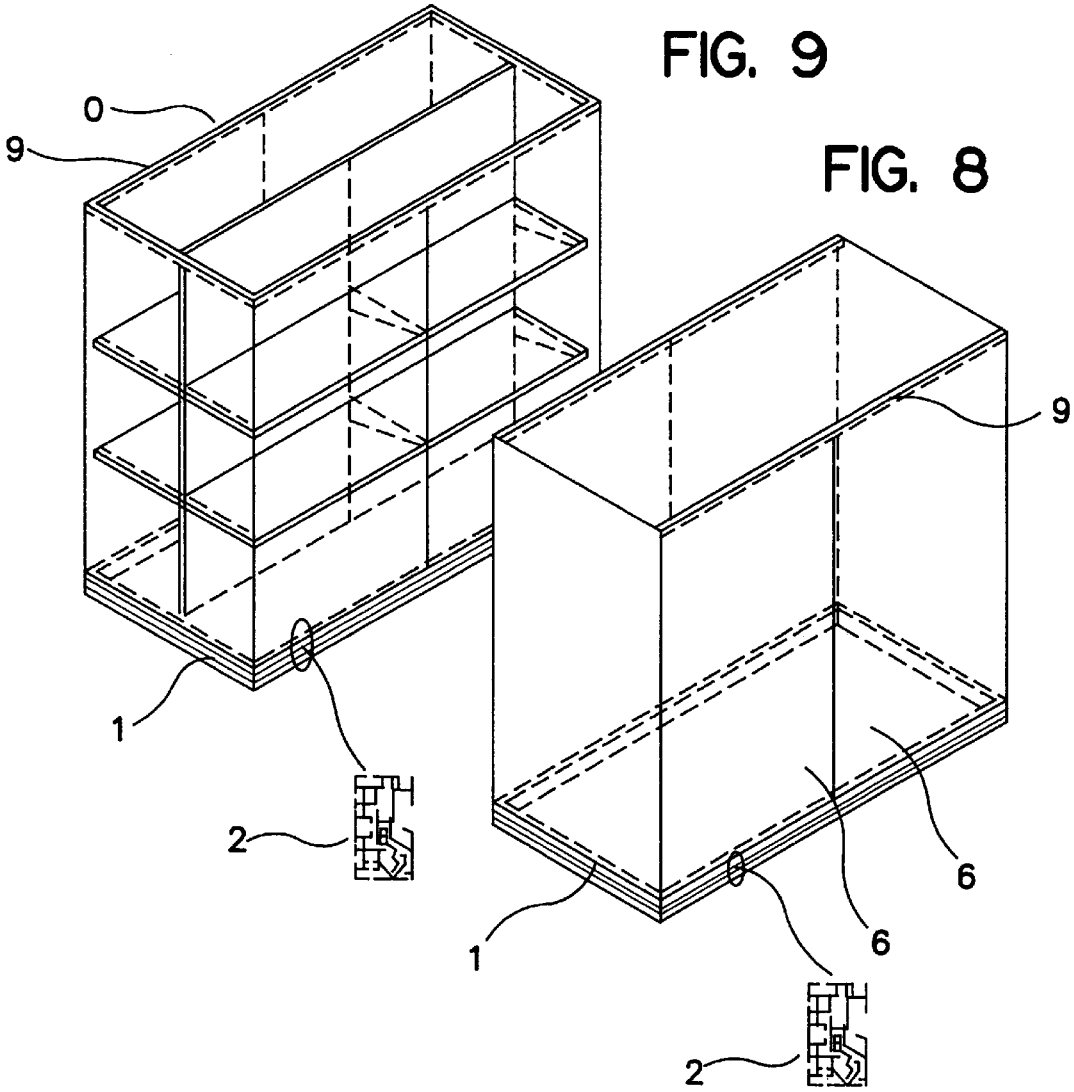

OBJECT WITH FORWARD AND SUBSEQUENT LATERAL DISPLACEMENT OF FORWARD MOVABLE SURFACES

FIELD OF TECHNOLOGY

The invention concerns objects with forward and subsequent lateral displacement of forward movable surfaces, particularly display cases, cabinets and doors, the common opening characteristic of which is the combination of the forward displacement of the surface closing the volume of the object with the subsequent movement of this surface to any side.

BRIEF DESCRIPTION OF THE RELATED ART

Objects with forward moving doors are known in which the lower and upper parts of the moving doors are provided with a tipping or forward moving mechanism enabling the forward movement of the forward movable doors. Once the doors have been moved forward they are supported on guide rails which allow their subsequent lateral movement. This arrangement is used in forward moving doors of e.g. rail-bound and other vehicles. The arrangement of forward moving and guiding mechanisms in both the lower and the upper parts of forward movable doors is a disadvantage in some applications of forward movable doors. The cumbersome character of this design manifests itself markedly e.g., in the application of forward movable doors to display cases or similar applications in the furniture industry.

An analogous problem of forward movable doors is addressed by the Austrian Patent No. 295,072. Built into the cabinet floor there is a rocking adjustable member controlled by a lever mechanism mounted in solid wall components. The fronts of the solid wall components and the sliding door are in one plane in a closed position. By means of the rocking adjustable member the lever mechanism shifts the door provided with rolls onto the adjacent rail along which they can move laterally. The lever mechanism controlling the rocking adjustable member is complicated and necessitates firm mounting in the solid front wall of the cabinet. controlling the rocking adjustable member is complicated and necessitates firm mounting in the solid front wall of the cabinet.

The French Patent No. 149,950 concerns sliding plates, such as doors and glazing covering openings. Lateral movement of glass is enabled by the wheels moving in grooves which simultaneously prevent glass oscillation in a vertical plane.

The U.S. Pat. No. 4,112,622 concerns a roller assembly for sliding screen doors. It describes the mounting of a roller, rotating on a pin firmly fastened to lateral sides forming a roller housing. The lateral sides of the roller housing are held together by adequate stress between the lateral housing sides and lateral walls of the channel in which the roller housing is located.

The U.S. Pat. No. 2,508,972 concerns the design of a device for the closing of large and heavy doors of airplane hangars and the like. The door frame is provided with a part with a cut and the lateral part of the door is provided with a pin matching the cut after closing. The U.S. patent also concerns a set of sliding doors. To facilitate the door movement a spring is inserted between the sliding roller and the lateral part.

The Austrian Patent No. 339,531 describes extendable overlapping doors for furniture pieces. Two or more adjacent extendable doors in a closed position of the object are in the same level plane. In the opened position of the object the doors are superimposed one in front of the other and can be shifted by means of rollers in a channel-like groove fastened on the adjacent door. Their lateral guidance is in a straight line, and by means of rollers, on which they are suspended. The doors run in a V-groove of an extender, which is extendable in a direction perpendicular to the lateral guidance of the door. The extender moves by its edges by means of the rollers between two rails fastened to the side walls of the case and to the intermediary ceiling of the case. The rails situated on both side walls of individual compartments of the case together with the rollers which are a part of the extender provide for the extension of the door. The rails are perpendicular to the plane of the extended door. Each extendable door requires its own rail assembly. The whole weight of the door is transferred over the rollers onto the rails, which means that the rails must have a sufficient length and a reliable fastening to the side walls and to the intermediate ceiling of the case to support the door. Consequently, the solution requires strong, not transparent side walls of individual case compartments and a strong upper wall of the case. This solution cannot be used for cases where the length of the extendable doors is less than the distance between the side walls.

All of the above-mentioned patents solve only the problem of opening one part or one whole wall of the object. Such objects cannot be transparent and cannot open and close in turn any side as may be required just for the display cases intended for exhibitions and museums.

SUMMARY OF THE INVENTION

The disadvantages of the above-mentioned arrangement are eliminated by an object with a forward and subsequent lateral displacement according to the present invention. The invention involves forward and then lateral travel of mutually overlapping surfaces of objects such as display boxes and cases. The mutually forward movable surfaces are firmly fastened in mutually forward movable bearing sections. The bearing sections are freely seated on a guide surface of action elements, which are seated with rocking or shifting freedom in the object. One deflected and overlapping surface is moved by means of the bearing section on the bearing section of an adjacent surface. The object consists of mutually forward movable surfaces, and at least one load-bearing frame, which is either straight or has an n-polygonal periphery form, "n" being at least 3. The load-bearing frame connects individual walls of the n-polygonal formation on the periphery of at least one wall. A part of the frame is a linear compact assembly, which is parallel with the planes of the mutually forward movable surfaces. The linear compact assembly consists of a principal structural section, with a constant cross-section along an entire length situated in parallel to the plane of the mutually forward movable surface having a constant cross section along their whole length, freely seated inside of the principal structural section, in a seat, running along the whole length of the principal structure section. The principal structural section is, along its whole length, in contact with an array of arranged action elements. The linear compact assembly also consists of at least two identical mutually forward movable bearing sections, having a constant cross-section along their whole length and firmly connected with mutually forward movable surfaces along their whole length. In each mutually forward movable bearing section along its whole length a mobile assembly is situated with a freedom of motion on a guide surface of the action element, running along the whole length of the action element, in parallel with the plane of said mutually forward movable surfaces. The travel of the action element is limited by two stops, constituted in the principal structural section. The bearing sections is also provided with a guideway running along its whole length enabling the motion of the adjacent mutually forward movable surface.

In the "closed" position the action element is in contact with the first stop, in the "open" position the action element is in contact with the second stop and the mobile assembly of the bearing section is in a position enabling its motion along the guideway of the adjacent bearing section. The adjacent bearing section is mounted movably in the principal structural section via the adjacent action element.

The bearing section is provided with a first contact surface which, in the "closed" position, is in contact with the second contact surface provided in the principal structural section.

The first contact surface may consist of a projection and the second contact surface may include a recess or vice versa. Advantageously the bearing section is provided with a projection which is in contact with the recess in the principal structural section in the "closed" position.

The mobile assembly of the bearing section is mounted to advantage so as to roll along the guide surface of the action element which consists of a lever rocking in the seat in the principal structural section. The mobile assembly consists advantageously of at least one travel wheel mounted in two side plates fixed in the bearing section by two flat springs.

The mobile assembly mounted in the bearing section may be a roller (pulley). The guideway and the guide surface are of cylindrical shape to accommodate the mobile element. The action element, which is provided with a guide surface, may slide in the principal structural section between two stops.

The forward movable surface firmly fixed with the bearing section may be suspended or may be firmly fixed with the bearing section from below or may move in a horizontal direction.

All possible positions may be combined in one object. In case of the suspended forward movable surface the guideway is provided in the bearing section opposite the firm jointing of the forward movable surface with the bearing section, while the center of the guide surface, after the motion of the action element from the first stop in the "closed" position to the second stop in the "open" position, aligns with the center of the guideway provided in the bearing section in the "closed" position, or with the center of the guideway provided in the adjacent bearing section. The shape of the soffit surface of this principal structural section follows the trajectory of the end part of the bearing section provided with an ancillary roller (pulley) during this motion.

In the end part of the bearing section there is a stabilizing element which is in contact with the internal stabilizing surface of the principal structural section during this motion. The stabilizing element in the end part of the bearing section consists of a roller (pulley) or a ball bearing.

Near the lower fastening of the forward movable surface the bearing section is provided with a stabilizing element which is, in the "open" position, in contact with the stabilizing surface of e.g. a U-shape in the adjacent bearing section which is in the "closed" position.

The free part of the forward movable surface is fitted, in the "closed" position, between juxtaposed surfaces of the principal closing section forming part of the object, of which the forward movable surfaces form a part. The free part of the forward movable surface may be provided also with a trimming section.

In the principal structural section there is a compression spring. The principal structural section also contains grooves for the installation of the mechanisms for the suspension of shelves, lighting, and the connection of supplementary display case elements. The bearing section contains a locking mechanism.

The weight of the forward movable surface is distributed over the whole principal structural section along the whole length of the action element and consequently over the whole length of the bearing section with which the corresponding action element is in contact.

This completely novel pattern of load transmission enables the object to consist of only one load-bearing frame comprising individual transparent walls of an n-polygonal object, while permitting at the same time their overlapping and shifting over the adjacent surface of the same wall of the object. All level as well as vertical walls of the object can be totally transparent at the same time. No other solution enables a full transparency of the whole object and gradual opening of all sides of the object, deflecting and lateral shifting of a forward movable surface over an adjacent forward movable surface at the same side of the object.

The load bearing frame connects individual walls of the object and their mutually forward movable surfaces. It has a linear form in a case when the object has only one wall with deflectable overlapping surfaces. Alternatively, the frame has a form of an n-polygon, having a form identical with the ground plan of the object.

In single-wall objects the load-bearing frame is identical with the linear compact assembly, providing for a linear integration of individual forward movable surfaces forming the wall. In the case of n-polygonal objects the frame is composed of linear compact assemblies running along the whole length of the upper and/or the bottom object wall edge, and of corner ferrules.

The object according to the invention enables the forward displacement of the surface and its lateral movement. At the same time the surface is continuously secured during its forward motion in a vertical or horizontal position. The forward displacement and the lateral movement of the surface is assured by a single element, the linear compact assembly. The forward displacement and subsequent lateral movement do not require any other handling elements or guideways for the displacement of the surfaces. The invention enables easy interchangeability of individual surfaces. The linear compact assembly may be used for the lower or the upper fastening of the surface for its motion in a vertical direction or for motion in a horizontal direction. It enables the creation of a cabinet or a glass display case in which the linear compact assembly will form part of the upper or lower frame or an integral upper or lower structural frame.

Thanks to the adequate kinematic characteristics of its closing mechanism (the sealing pressure force is due to the weight of the surfaces) the object is dust tight and/or vapor tight.

Opening and closing of the object space by means of the forward movable surfaces is easy and fast. The size of the surfaces is practically unlimited and their opening does not impose any further space requirements. During the opening of one surface the weight of the whole display case including exhibits is sustained by adjacent surfaces. The transport, dismantling and assembly of the display case is very simple. The individual parts of the case are easily interchangeable. The object can be mounted on a pedestal or suspended.

BRIEF DESCRIPTION OF THE DRAWINGS

FIG. 5 shows a basic module of an all-glass cabinet or display case with upper travel mounted on a base;

FIG. 6 shows a modular series of display cases with upper travel mounted on a base;

FIG. 7 shows a large space type all-glass cabinet or display case with upper travel mounted on a blase;

FIGS. 8 and 9 show a large space type all-glass cabinet or display case with lower travel mounted on a base;

DETAILED DESCRIPTION OF THE PREFERRED EMBODIMENTS

EXAMPLE 1

Figures 1, 1A:
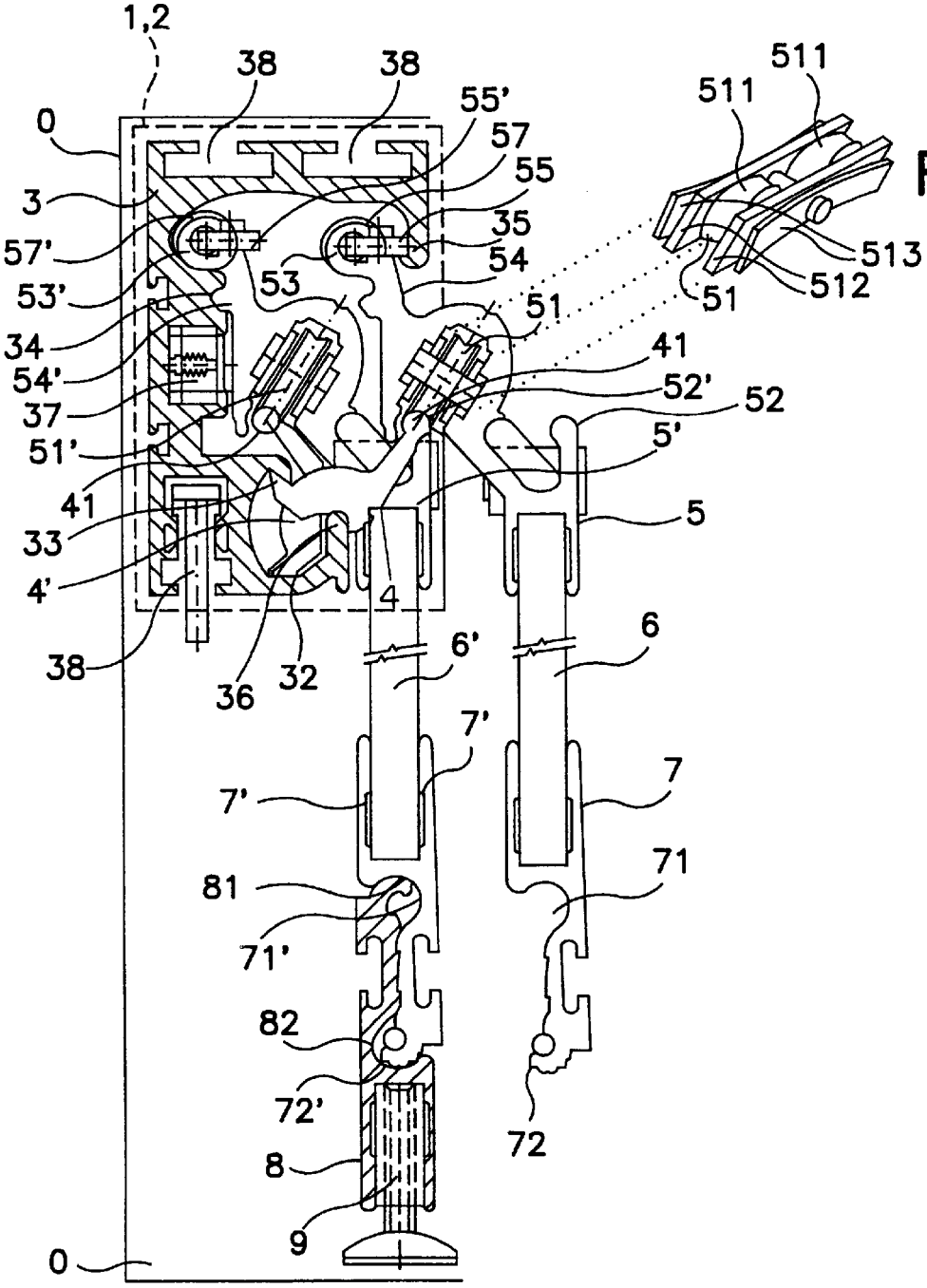
FIG. 1 shows the cross section of the linear compact assembly 2 for the suspended forward movable surface 6 and its anchorage and locking to the base.
FIG. 1A is a perspective view of the wheel assembly of FIG. 1.

FIG. 1 shows a cross section of the liner compact assembly 2 for forward and subsequent lateral displacement of a suspended forward movable surface 6 such as a sliding door. FIG. 1 also shows the anchorage and locking of the movable surface 6 to the base.

The linear compact assembly 2 consists of the principal structural section 3 and at least two mutually forward movable bearing sections 5 firmly connected with the movable surfaces 6, and at least one action element 4. In every bearing section 5 there is a wheel assembly 51 mounted movably on a guide surface 41 of the action elements 4. The action element 4 is placed within the principal structural element 3. The movement of action element 4 is limited by two stops 32 and 33 provided in the principal structural section 3. The bearing section 5 is further provided with the guideway 52. The guideway 52 and the guide surface 41 are cylindrical.

In the "closed" position the action element 4 is in contact with the first stop 32. In the "open" position the action element 4 is in contact with the second stop 33 and the wheel assembly 51 of the bearing section 5 is in the position enabling its movement along the guide surface 41 of the action element 4 and the guideway 52 of the adjacent bearing section 5'. The adjacent bearing section 5' is movably mounted in the principal structural section 3 via the adjacent action element 4'.

The wheel assembly 51 of the bearing section 5 rolls along the guide surface 41 of the action element 4, consisting of the lever rocking in the seat 36 provided in the principal structural section 3. The bearing section 5 is provided with the first contact surface—projection 54 which is, in the "closed" position, in contact with the second contact surface—recess 34 provided in the principal structural section 3.

Opposite the fixed connection of the forward movable surface 6 with the bearing section 5 a guideway 52 is provided in the bearing section 5. The center of the guide surface 41, after the movement of the action element 4 from the first stop 32 in the "closed" position to the second stop 33 in the "open" position, is aligned with the center of the guideway 52 provided in the bearing section 5 in the "closed" position and/or the center of the guideway 52' provided in the adjacent bearing section 5'. The shape of the soffit surface of the principal structural section 3 follows during this movement the trajectory of the end part 53 of the bearing section 5 provided with and ancillary roller (pulley) 57.

In the end part 53 of the bearing section 5 there is a stabilizing element 55 which is, during the movement to the "open" position, in contract with the stabilizing internal surface 35 of the principal structural section 3. The stabilizing element 55 in the end part 53 of the bearing section 5 consists of a roller (pulley).

The lower free part of the forward movable surface 6 is mounted in the trimming section 7 which is provided with two juxtaposed seating surfaces 71 and 72. In the closed position, the seating surfaces 71 and 72 are in contact with the opposite surfaces 81 and 82 of the countershape of the principal closing section 8 forming part of the lower frame 9 of the object 0 of which the forward movable surfaces 6 form part.

Inside the principal structural section 3 there is a compression spring 37.

The principal structural section 3 is provided with grooves for the installation of the mechanisms for the suspension of shelves, lighting and connection of supplementary elements of the display case 38.

FIG. 1A shows the wheel assembly 51 consisting of two travel wheels 511 mounted between two side plates 512, fixed in the bearing section 5 by two flat springs 513.

If sufficient horizontal force is applied to the guideway 52 of the bearing section 5 acting on the forward movable surface 6 in FIG. 1, the action element 4 starts rotating forward. This forward force on the guideway 52 moves the forward movable surface 6 forward to the outer "open" position. Thanks to the stabilizing element 55, consisting in this case of the roller (pulley) installed in the part 53 of the bearing section 5, and the rounded shape of the soffit surface of the principal structural section 3, the forward movable surface 6 remains vertical even in this position and any undesirable inclination of the forward movable surface 6 is eliminated.

Simultaneously with the rotation and lifting of the action element 4 the trimming section 7 is also lifted and leaves the closing section 8. The permanently vertical position of the forward movable surface 6 guarantees that during the forward movement of the forward movable surface 6 the trimming section 7 will not return to the contact surfaces 81 and 82 of the principal closing section 8.

As in the forward position of the forward movable surface 6 the guide surface 41 of the action element 4 aligns with the guideway 52' of identical shape, provided in the adjacent bearing section 5. A lateral force may cause a lateral displacement of the forward movable surface 6 along the adjacent guideway 52' of the adjacent bearing section 5 carrying the adjacent surface 6' in the "closed" position which opens the space previously closed by the forward movable surface 6.

Thanks to the stabilizing element-roller (pulley) 55 running along the interior surface 35 of the principal structural section 3 the forward movable surface 6 occupies a permanently vertical position. Instead of a roller (pulley) the stabilizing element 55 may consist of a material of low friction coefficient not requiring lubrication.

The number of the movable surfaces 6 described above may be arbitrary, while the length of the principle structural section 3 equals the sum of the widths of the individual forward movable surfaces 6. If the forward movable surfaces 6 are used in display cases, they will generally be made of glass. For furniture making purposes they may also be made of other materials. The prismatic exterior shape of the principal structural section 3 enables the vertical superposition of several display cases. When the forward movable surface 6 is closed, its weight is sustained by the principal closing section 8. The weight of the movable surface 6 on the wheel assembly 51 is relieved when the movable surface is closed and is loaded only when the forward movable surface 6 has been moved forward.

EXAMPLE 2

Figure 2:
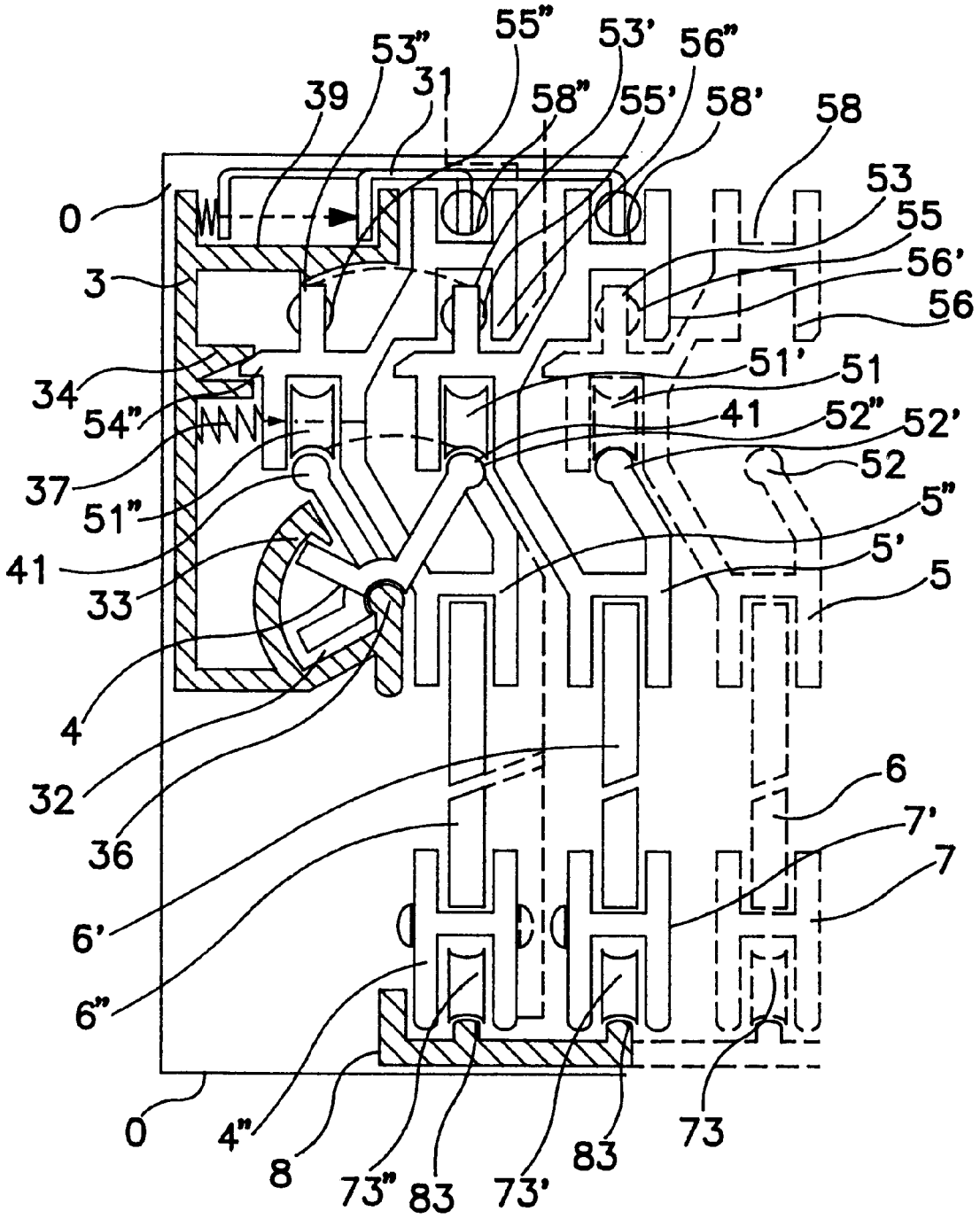
FIG. 2 shows the cross section of the universal compact assembly 2 which enables the opening and the lateral movement of several surfaces, placed in several rows, simultaneously.

FIG. 2 shows a cross section of the universal compact assembly 2 enabling the opening and lateral displacement of several movable surfaces 6 placed in several rows, simultaneously. The liner compact assembly is analogous with that shown in Example 1 with the following differences:

On the end part 53 of the bearing section 5 there is a stabilizing element 55 consisting of a ball which is, after the forward motion to the "open" position and subsequent lateral displacement, in contact with the stabilizing surface 56 of the adjacent bearing section 5'. Opposite each stabilizing surface 56 a stabilizing groove 58 is provided in the bearing sections 5, with a stop 31 securing the forward movable surface 6 in vertical position after its forward movement.

The free part of the forward movable surfaces 6 is fitted in the trimming section 7. In the trimming section 7 there is a wheel 73 which is in contact with the guideways 83 provided on the principal closing section 8.

This structure enables the displacement of the surface 6 and its suspension on the adjacent bearing section 5'. Subsequently both surfaces can be transferred to the "open" position by the movement of the action element and simultaneously superpassed in front of another adjacent surface 6". Additional movable surfaces 6 can be further arranged behind one another in accordance with the design.

EXAMPLE 3

Figure 3:
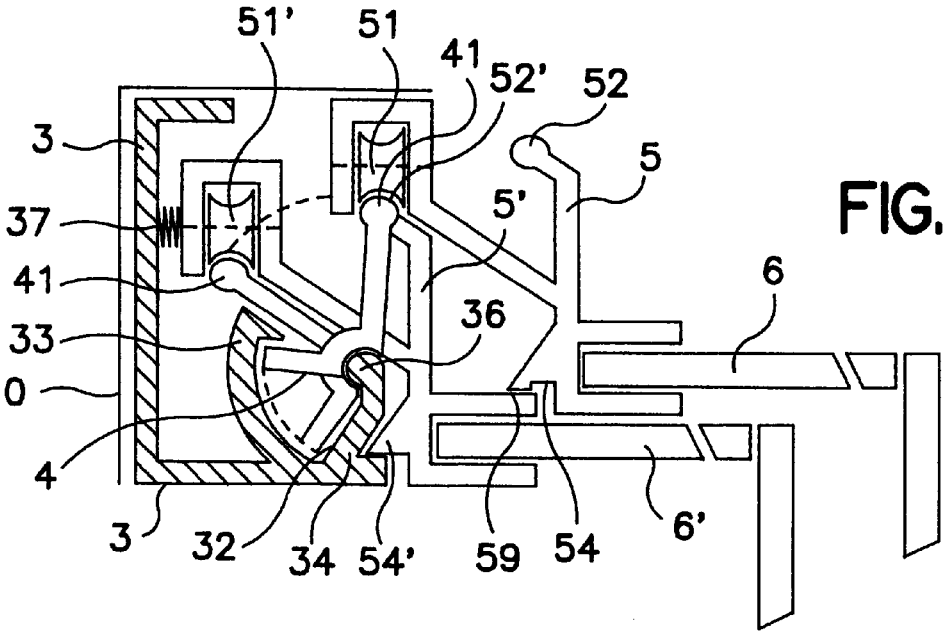
FIG. 3 shows the cross section of the universal compact assembly 2 for the horizontal displacement of the forward movable surface 6.

FIG. 3 shows a cross section of the linear compact assembly for the horizontal displacement of the forward movable surface 6 having an inverted L-shaped cross-section.

Analogously with Example 1 the assembly consists of the principal structural section 3 and at least two mutually forward movable bearing sections 5 firmly connected with the mutually forward movable surfaces 6 and action elements 4. In every bearing section 5 there is a wheel assembly 51 moving along the guide surface 41 of the action element 4 installed in the principal structural section 3. The movement of the action element 4 is limited by two stops 32 and 33 provided in the principal structural section 3. The bearing sction 5 is further provided with a guideway 52.

The mobile element 51 of the bearing section 5 rolls along the guide surface 41 of the action element 4 consisting of a lever rocking in seat 36 provided in the principal structural section 3.

The bearing section 5 is provided with a projection 54 which is, in the 'closed position, in contact with the recess 34 provided in the principal structural section 3. In the "open" position the projection 54 is in contact with a flange 59 of the adjacent section 5'. The flange 59 forms part of the firm connection of the bearing section 5 with the forward movable surface 6.

In the principal structural section 3 there is a compression spring 37.

This linear compact assembly enables the displacement of the horizontally fastened forward movable surface 6 analogous with that described in Example 1.

EXAMPLE 4

Figure 4:
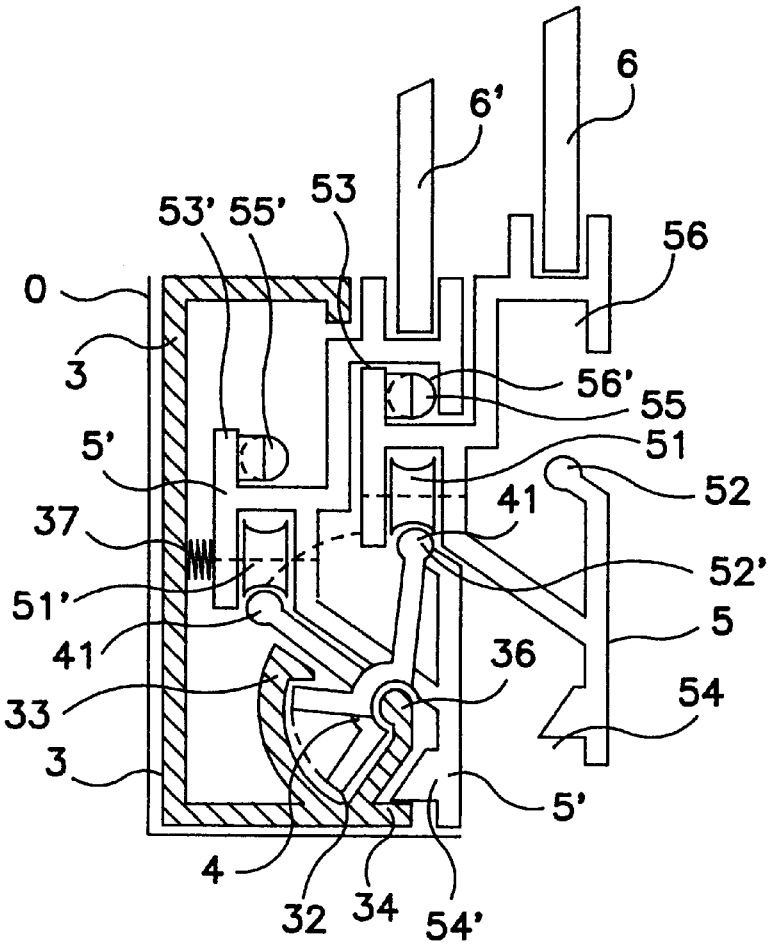
FIG. 4 shows the cross section of the linear compact assembly 2 for the lower fastening of the forward movable surface 6.

FIG. 4 shows a cross section of the linear compact assembly 2 for the lower fastening of the forward movable surface 6.

The linear compact assembly 2 consists of the principal structural section 3 and at least two mutually forward movable bearing sections 5 firmly connected with forward movable surfaces 6 and action elements 4. In every bearing section 5 there is a wheel assembly 51 running along a guide surface 41 of the action element 4 installed in the principal structural section 3. The movement of the action element 4 is limited by two stops 32 and 33 provided in the principal structural section 3. The bearing section 5 is further provided with a guideway 52. The guideway 52 and the guide surface 41 are cylindrical.

In the "closed" position the action element 4 is in contact with the first stop 32. In the "open" position the action element 4 is in contact with the second stop 33 and the wheel assembly 51 of the bearing section 5 is in a position enabling its movement along the guideway 51' of the adjacent bearing section 5'. The adjacent bearing section 5' is movably mounted in the principal structural section 3 via the adjacent action element 4'.

The wheel assembly 51 of the bearing section 5 rolls along the guide surface 41 of the action element 4 consisting of a lever rocking in the seat 36 provided in the principal structural section 3.

The bearing section 5 is provided with a projection 54 which is, in the "closed" position, in contact with the recess 34 provided in the principal structural section 3 located simultaneously with that shown in Example 3. In the "open" position the projection 54 is free.

The bearing section 5, however, is provided with a stabilizing element 55. In the "open" position and during subsequent lateral displacement, the stabilizing element is in contact with the stabilizing surface 56' of the adjacent section 5' which is in the "closed" position. The stabilizing element 55 is a ball.

The principal structural section 3 contains a compression spring 37. The method of opening of the object 0 in case of lower fastening of forward movable surfaces 6 is analogous with Example 1.

EXAMPLE 5

FIG. 5 shows an all-glass cabinet or display case with upper travel mounted on a base. The liner compact assembly 2, such as the assembly of FIG. 1, is mounted in the upper position in the soffit of the display case where it forms a self-contained frame 1. The individual glass plates or forward movable surfaces 6 are mounted in the bearing sections 5. The width of the forward movable surfaces 6 equals the length of the respective bearing section 5. The minimum number of forward movable surface 6 arranged in the longitudinal direction is n+1.

The lower frame consists of the closing section 8 matching, in an active position, with the trimming section 7. The rigidity of the cabinet is secured by structural cooperation of the lower and the upper frames 1 and 9 respectively via an adequately designed forward movable surface 6 and the characteristics of the linear compact assembly 2. During the displacement of any forward movable surface 6 opening of the case the weight of the case including exhibits is sustained by the upper and the lower frames 1 and 9 respectively and by the remaining or adjacent forward movable surfaces 6. The display case may be provided with a system of suspension wires anchored in the respective grooves of the principal structural section 3. Vertical adjustment of the shelves and their number are arbitrary. The upper part of the display case may be provided with lighting of a desired character.

EXAMPLE 6

FIG. 6 shows an all-glass cabinet or display case with upper travel mounted on a base. Pairs of liner compact assemblies 2 may be interconnected in a modular fashion with crossbeams forming an infinite linear frame 1 mounted in the upper position in the soffit of the display case. Further design and characteristics of the modular showcase are identical with Example 5.

EXAMPLE 7

Figure 17:
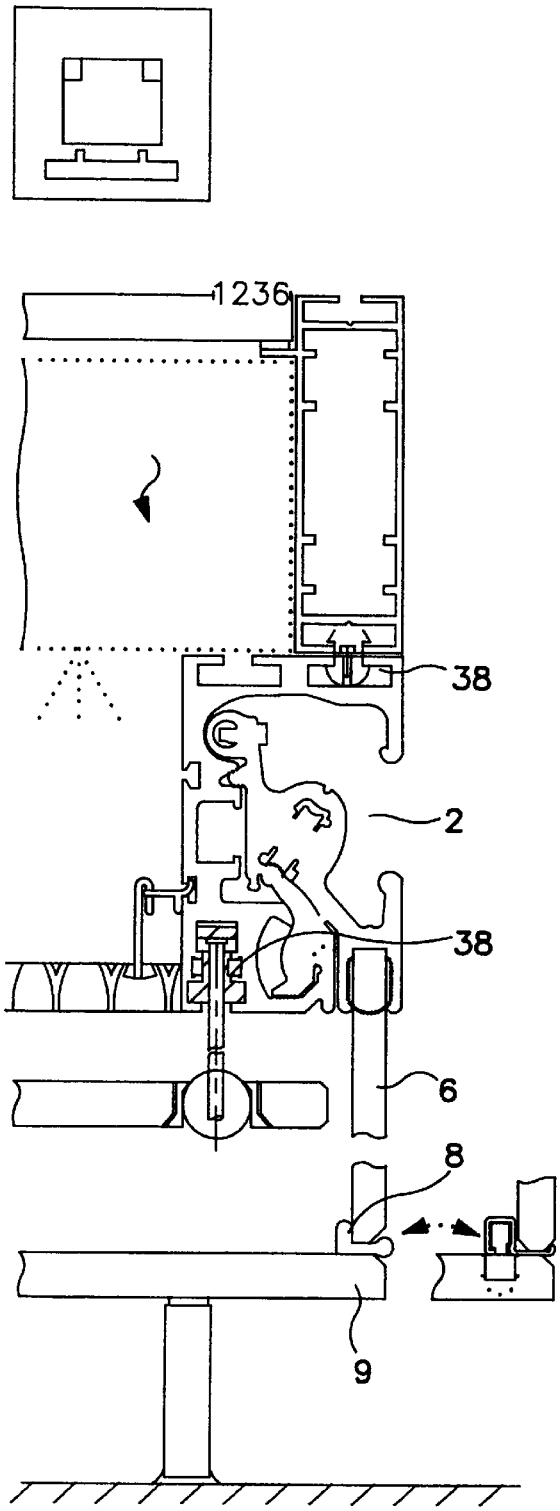
FIG. 17 shows the details of a display case with upper travel having a glass base.

FIG. 7 and FIG. 17 show an all-glass cabinet or display case with upper travel. This is a large space type cabinet mounted on a base. The upper frame 1 of the display case consists of linear compact assembly 2 extending in both longitudinal and transverse directions. In this display case it is possible to remove successively any forward movable surface 6 of any of the four walls. The shelves may be suspended in the same way as shown in FIGS. 5 and 6 or mounted on separate supports installed inside the display case. Further design and characteristics of the display case are identical with Example 5.

EXAMPLE 8

FIGS. 8 and 9 show an all-glass cabinet or display case with lower travel. This is a large space type cabinet mounted on a base. The linear compact assembly 2 is installed in the lower position in the floor of the display case and extends in both longitudinal and vertical directions, where it forms a self-contained frame 1. The upper frame 9 consists of the closing section 8 matching with the trimming section 7 in the inactive position. The rigidity of the cabinet is secured by structural cooperation of the upper and the lower frames 1 and 9 respectively via an adequately designed vertical forward movable surface 6 and the characteristics of the linear compact assembly 2. During the displacement of any forward movable surface 6 by opening of the display case the weight of the display case is sustained by the lower and the upper frames 1 and 9, respectively, and the remaining or adjacent forward movable surfaces 6. The individual glass plates or forward movable surfaces 6 are fitted longitudinally and transversely in the bearing section 5. Their width equals the length of the respective bearing section 5. The minimum number of forward movable surfaces 6 arranged in the longitudinal direction is n+1. The whole weight of forward movable surfaces 6 is transferred to the base through the linear compact assembly 2. FIG. 9 shows the provision of the display case with an inlaid cantilever system supporting any number of shelves. Further design and characteristics of the display case are identical with Example 5.

EXAMPLE 9

Figure 10:
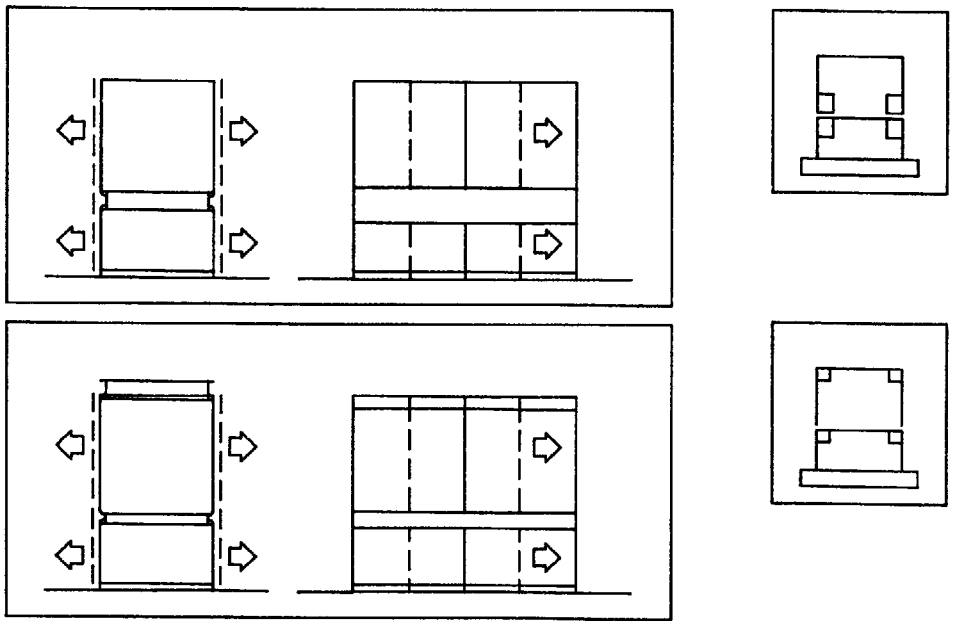
FIG. 10 shows a double type all-glass cabinet or display case with upper travel mounted on the floor.
Figure 19:
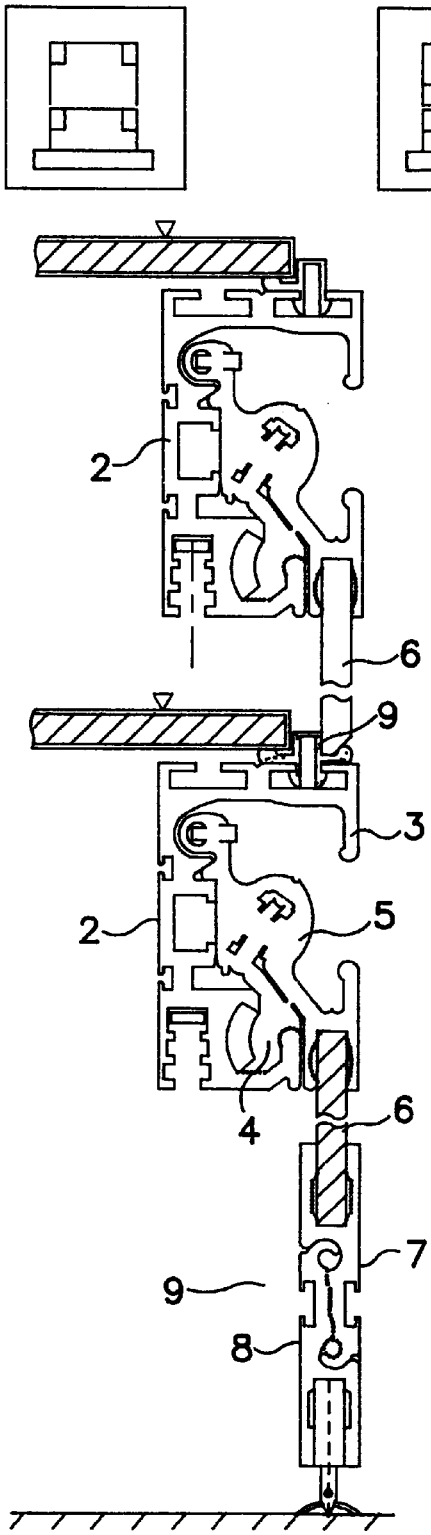
FIG. 19 shows the details of a double type display case with upper travel.

FIG. 10 and FIG. 19 show an all-glass cabinet or display case with upper travel. This is a double type cabinet mounted on a base. The object is analogous with Example 5 with the superposition of the individual display case or cabinets on top of one another. The lower frame 9 of the upper display case and the upper frame 1 of the lower display case, are firmly connected to one another. The forward movable surfaces 6 of both display cases can be mutually independently displaced and opened. Further design and characteristics of the display case are identical with Example 5.

EXAMPLE 10

Figure 11:
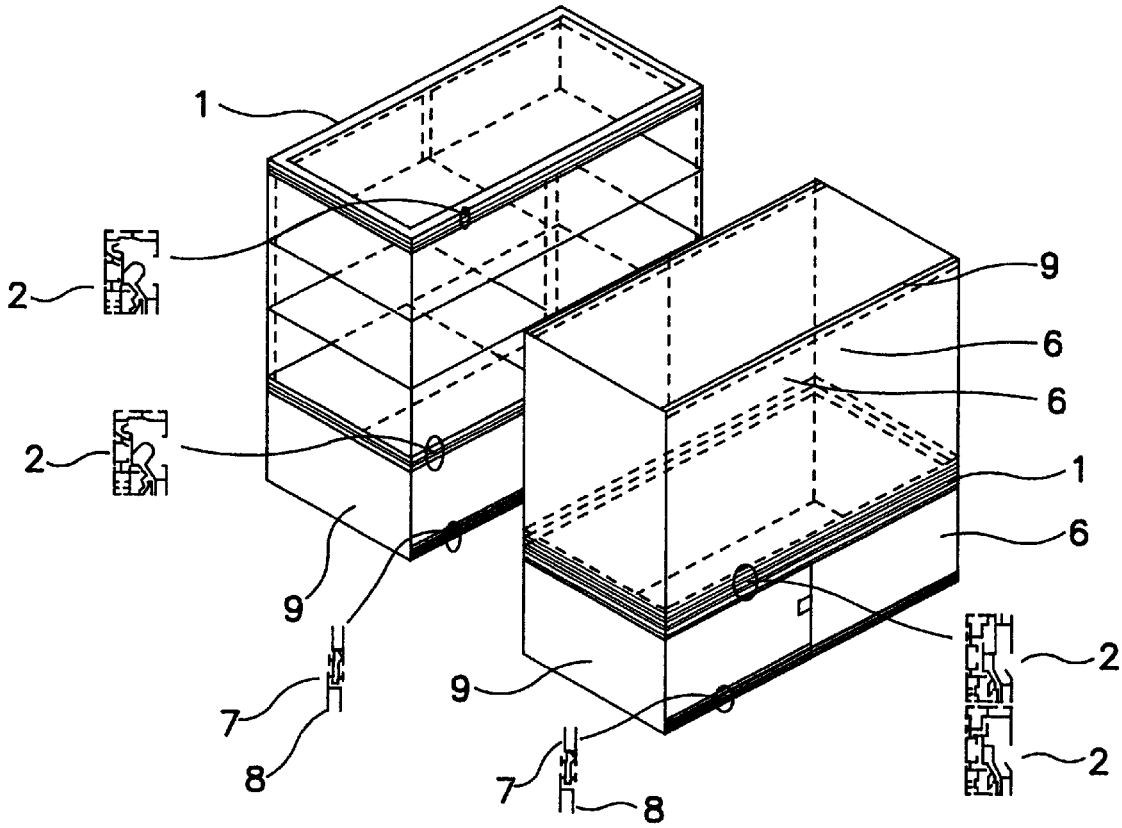
FIG. 11 shows an all-glass cabinet or display case with lower travel and an opening pedestal mounted on a base.
Figure 20:
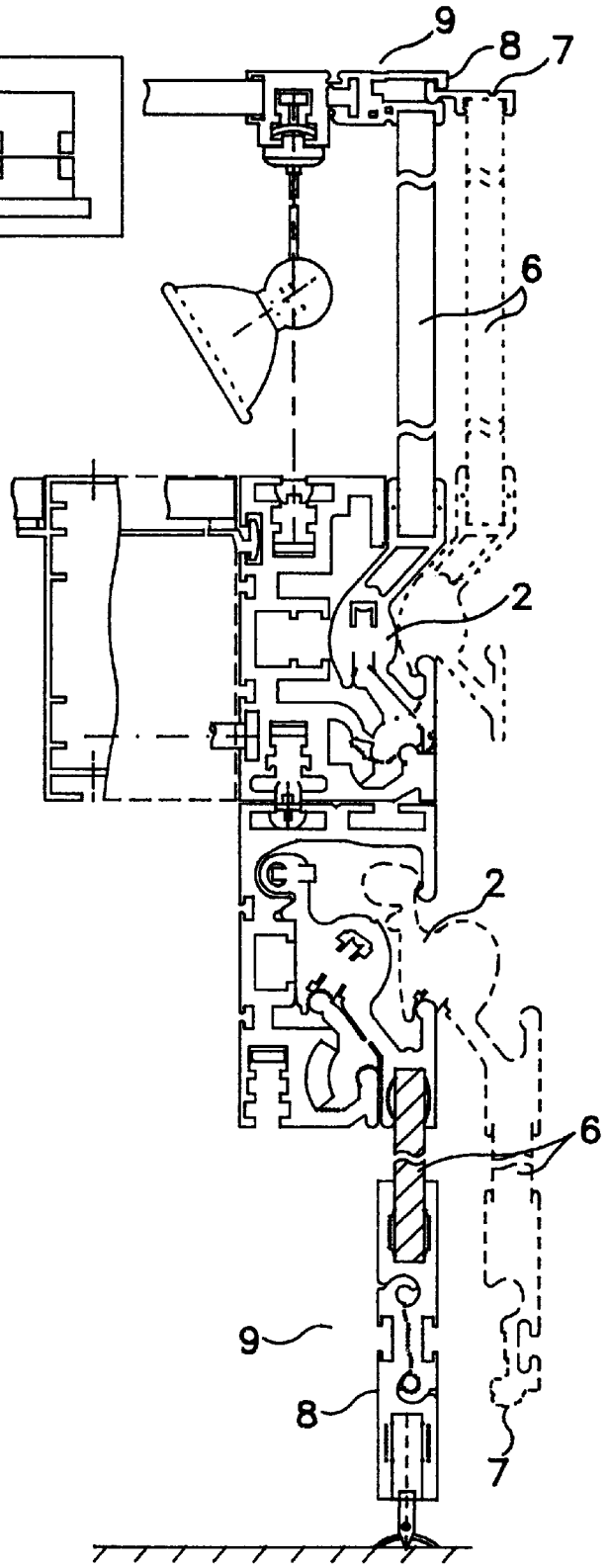
FIG. 20 shows the details of a combined type display case with upper and lower travel.

FIG. 11 and FIG. 20 show an all-glass cabinet or display case with lower travel and an opening pedestal mounted on a base. The object is analogous with Example 9. The pedestal is designed analogously with the display case and its surfaces 6 can be moved forward and opened in the same way as those of the display case. The linear compact assembly 2 is situated at the bottom or floor of the glass display case and at the upper part of the pedestal, where it forms self-contained frames 1. The upper frame 9 of the display case and the lower frame 9 of the pedestal consist of the closing section 8 matching with the trimming section 7 in inactive position. Further design and characteristics of the display case are identical with Example 5.

EXAMPLE 11

Figure 12:
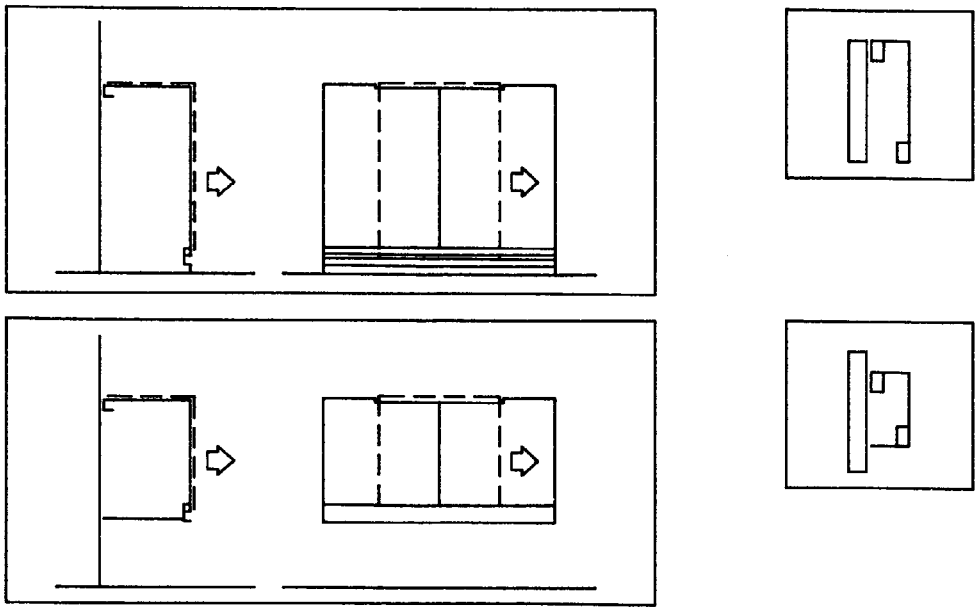
FIG. 12 shows an angular wall-mounted all-glass cabinet or display case, suspended on a wall.

FIG. 12 shows an all-glass cabinet or display case suspended on the wall. The linear compact assembly 2 is mounted both in lateral and lower positions of the display case at opposite ends of the movable surfaces 6. The forward movable bearing sections 5 are connected to individual, firmly jointed forward movable surfaces 6. The width of the forward movable surfaces 6 equals the length of the respective bearing sections 5. The minimum number of the plates arranged in longitudinal direction is n+1. The rigidity of the cabinet is assured by structural cooperation of linear compact assemblies 2 and the strength of the angular joint of adequately designed lateral and vertical forward movable surfaces 6. During the displacement of any of the angular (L-shaped) forward movable surface, i.e., opening of the display case, the weight of the display case including that of the exhibits is transferred by the adjacent surfaces 6 to the continuous linear compact assemblies 2 of the cabinet. Further design and characteristics of the case are identical with Example 5.

EXAMPLE 12

Figure 13:
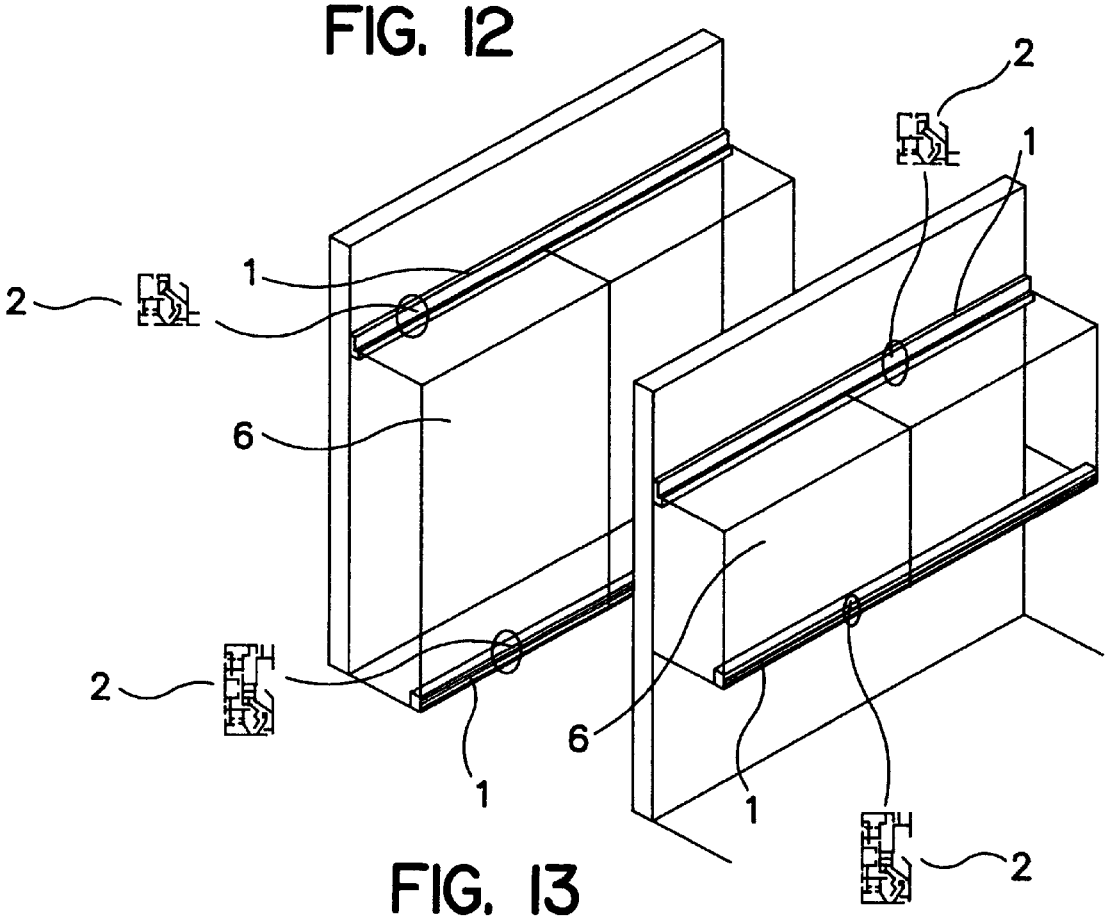
FIG. 13 shows an angular single-sided all-glass cabinet or display case, suspended on the wall and mounted on a base.

FIG. 13 shows an all-glass cabinet or display case, suspended on the wall and mounted on a base. The movable surfaces 6 have an L-shape cross section. The object is analogous with Example 11. The linear compact assemblies 2 are suspended on the wall in a lateral position and supported by a base in the lower position. Further design and characteristics of the display case are identical with Example 5.

EXAMPLE 13

Figure 14:
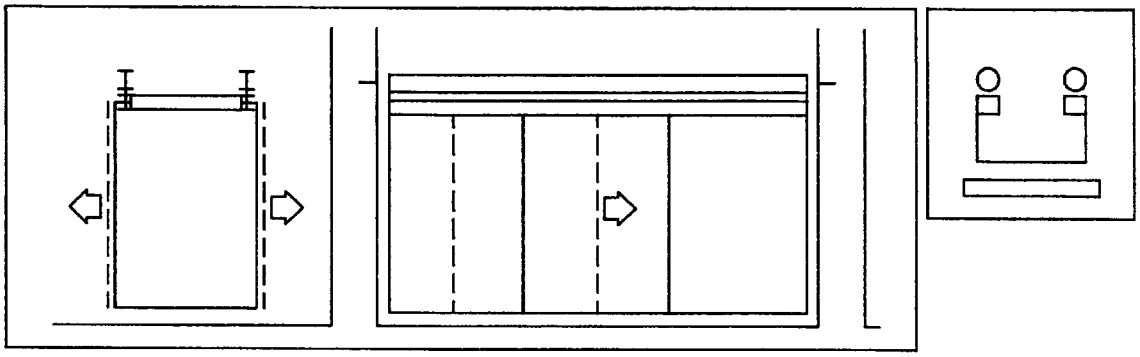
FIG. 14 shows an all-glass cabinet or display case with upper travel, suspended on a secondary support system.
Figure 14:
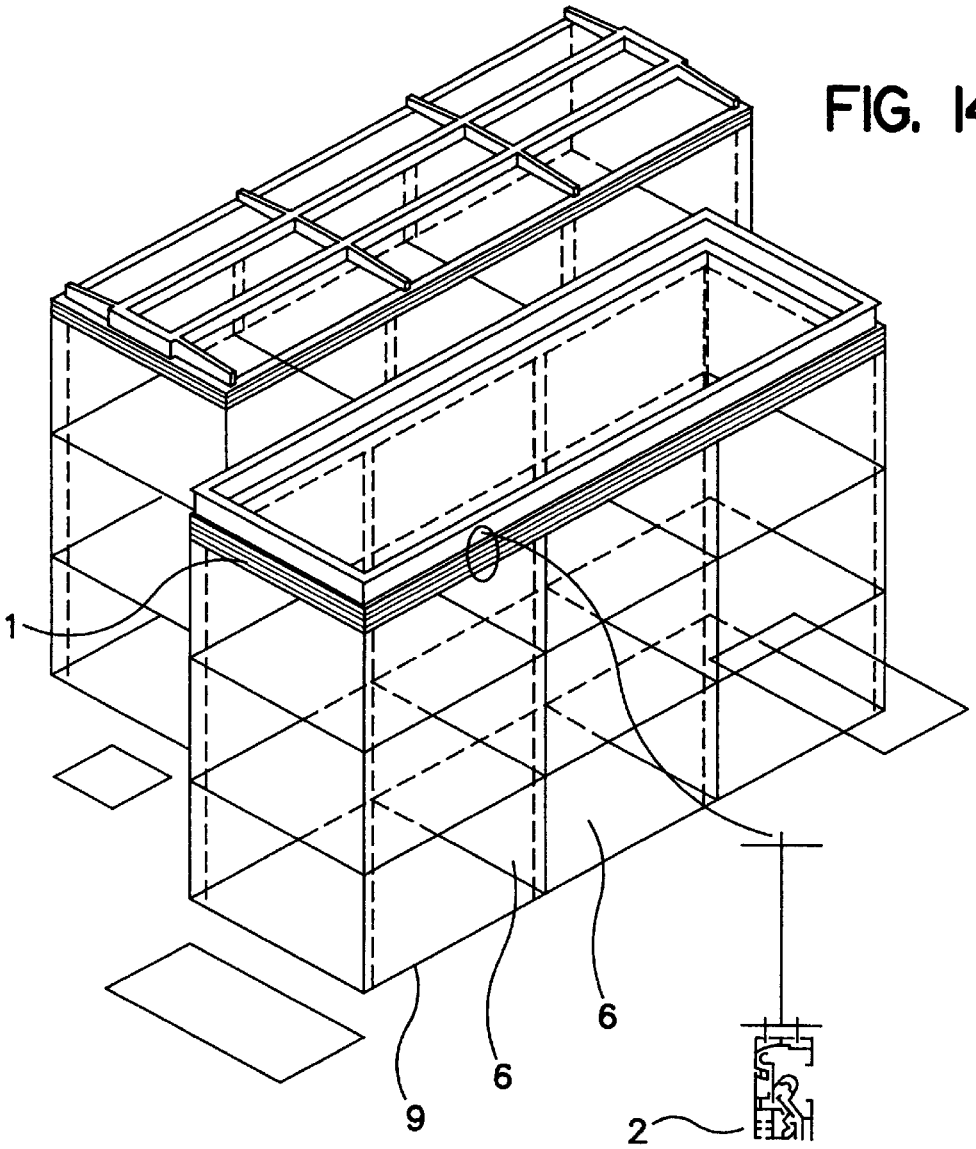
Figure 18:
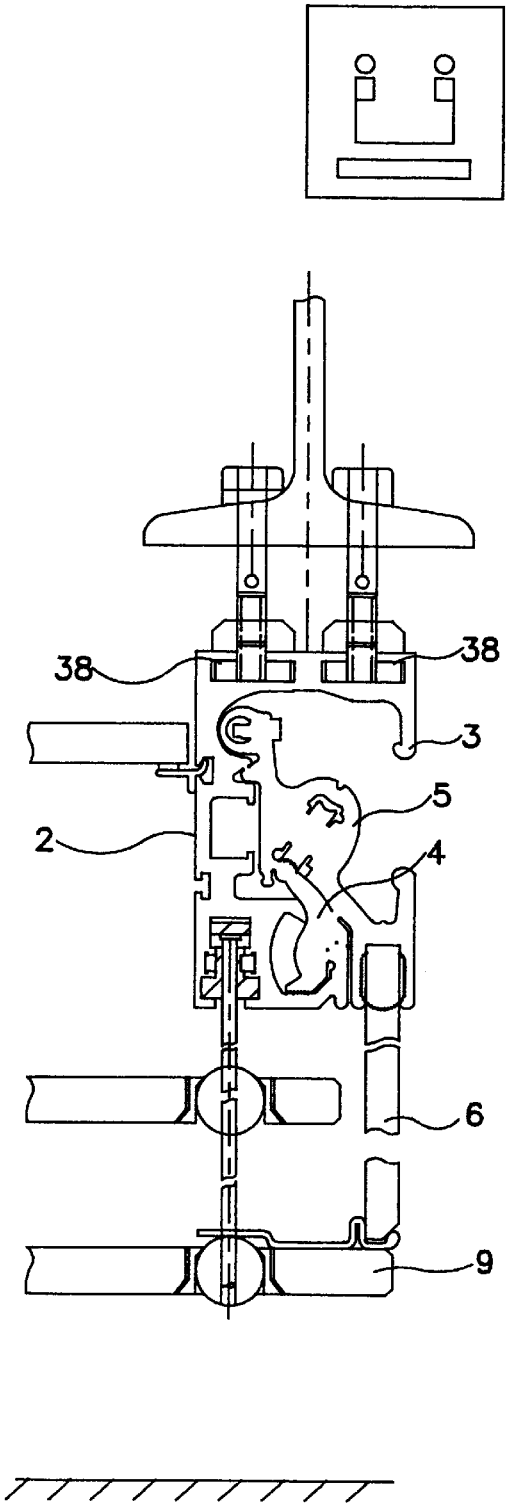
FIG. 18 shows the details of a display case with upper travel, suspended on a secondary support system.

FIG. 14 and FIG. 18 show an all-glass cabinet or display case with upper travel suspended on a secondary support system. The secondary support system is designed to carry the total weight of the display case including exhibits. The linear compact assembly 2 is firmly fastened to the suspension support system and bears the dead weight of the forward movable surfaces 6 which do not touch the base. The floor and the shelves of the showcase, if any, are suspended by a system of wires from the respective grooves in the principal structural section 3. The rigidity of the cabinet is secured by the cooperation of the upper linear compact assembly 2 via a vertical surface 6 of adequate design mounted in the trimming section 7 matching with the countershape of the closing section 8, firmly connected with the lower suspended shelf or floor of the showcase. In the closed position the weight of the display case including exhibits is transferred via the liner compact assembly 2 to the secondary supporting system forming part of e.g., the object structure. During the displacement of any surface 6 by opening of the case the weight of the forward movable surfaces 6 and suspended horizontal shelves is transferred to the remaining or adjacent forward movable surfaces 6 and the linear compact assemblies 2 of the cabinet. The vertical arrangement of the shelves and their number are arbitrary. The upper part of the display case may house lighting of a desired character. Further design and characteristics of the display case are identical with Example 5.

EXAMPLE 14

Figure 16:
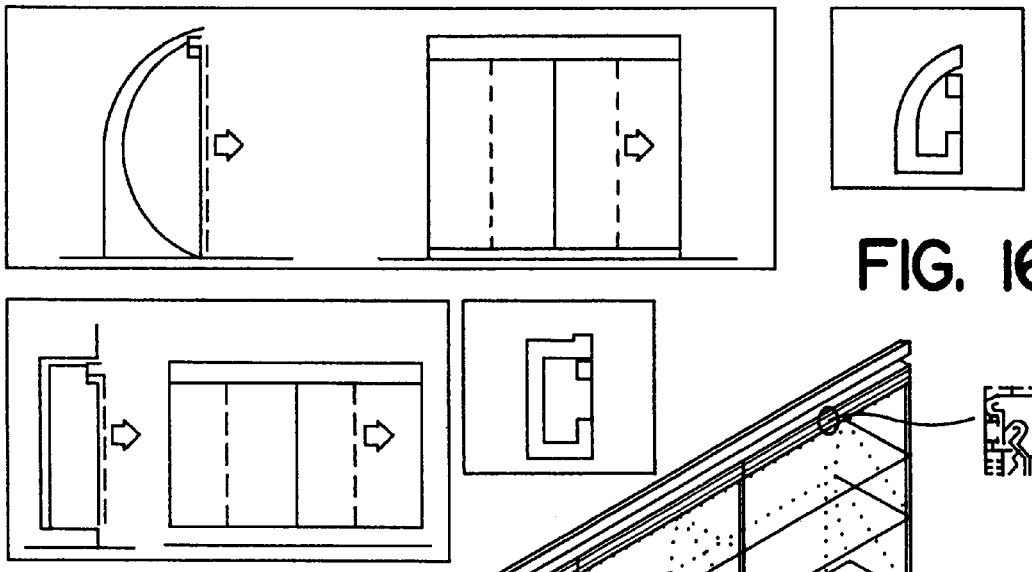
FIGS. 15 and 16 show a wall type single-sided glass wall display case with upper travel located in a niche and mounted on a blase.
Figure 15:
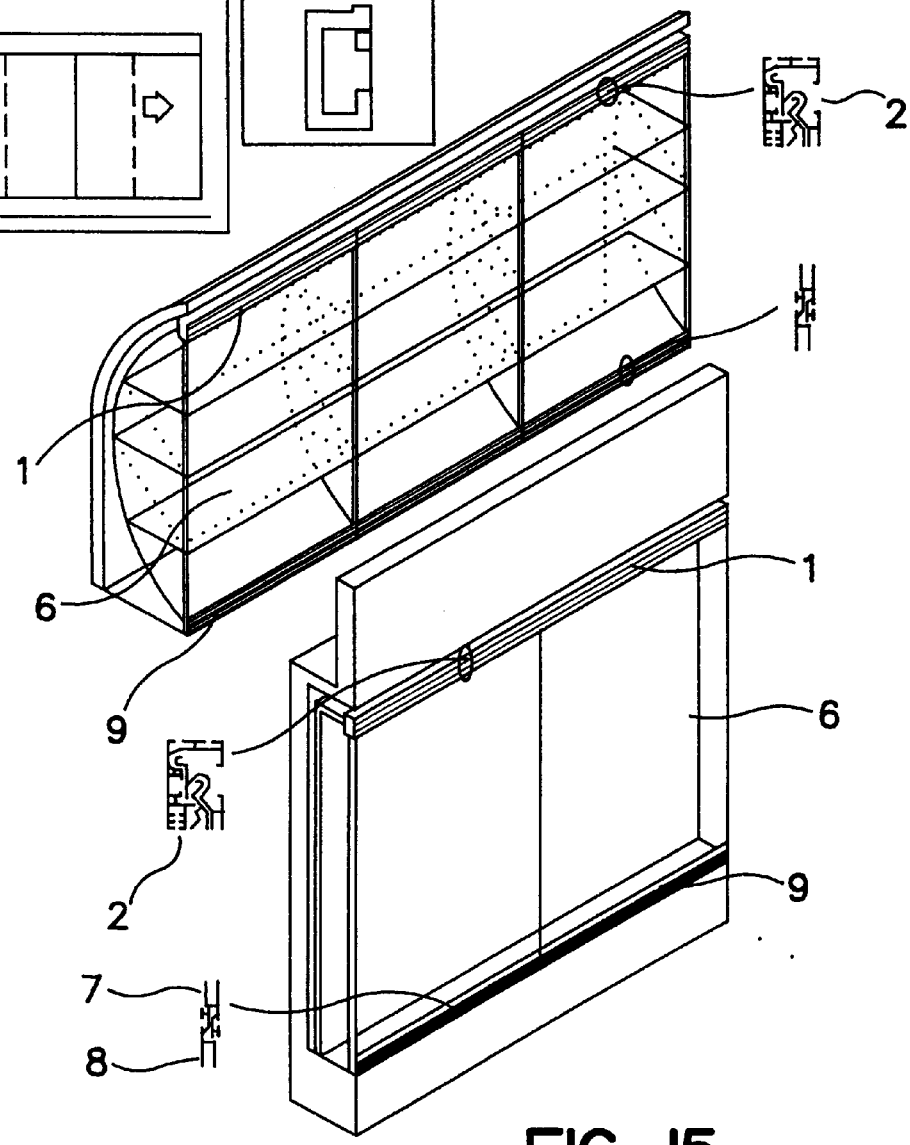

FIGS. 15 and 16 show a single-side glazed wall display case with upper travel installed in a niche and mounted on a base. The linear compact assembly 2 is installed in the upper part of the wall as a continuous load-bearing section connected with the ceiling. The lower linear frame 9 consists of the closing section 8, matching with the trimming section 7 terminating the forward movable surface 6 in the inactive or closed position. During the displacement of any surface 6 opening of the case the weight of the display case including exhibits is transferred to the remaining or adjacent surfaces 6 and frames of the wall. In the case of the object shown in FIG. 16 a wire ladder supporting the shelves is connected to the upper frame 1 and the lower frame 9. The whole weight of the exhibits in the display case is transferred to the base by means of the ladder via the upper principle structural section 3. The forward movable surface 6 of adequate design is provided with the trimming section 7. Further design and characteristics of the display case are identical with Example 5.

The object according to the invention is applicable to exhibition, construction and furniture industries.

I claim:

1. A door assembly providing forward and subsequent lateral displacement of a plurality of forward movable doors, the door assembly comprising:

at least one load-bearing frame supporting the plurality of forward movable doors comprising:

a compact linear assembly comprising:

a principal structural section;

at least two mutually forward movable bearing sections each fastened to one of the plurality of forward movable doors;

at least two action elements seated in the principal structural section and movable between forward and back positions;

a mobile assembly in each of the bearing sections transporting each of the plurality of forward movable doors along a guide surface of one of the action elements and along a guideway of an adjacent one of the bearing sections; and two stops provided in the principal structural section for limiting the movement of the action element.

2. The door assembly according to claim 1, wherein the bearing section is provided with a first contact surface which is, in a closed position of the door assembly, in contact with a second contact surface provided in the principal structural section, and wherein the first contact surface includes one of a projection and recess and the second contact surface includes one of a projection and recess.

3. The door assembly according to claim 1, wherein the mobile assembly of the bearing section rolls along the guide surface of the action element, and the action element consists of a lever rocking in a seat provided in the principal structural section.

4. The door assembly according to claim 1, wherein the guideway is provided in the bearing section opposite a fixed connection between the forward movable surface and the bearing section and wherein a center of the guide surface after movement of the action element from the first stop in the closed position to the second stop in the open position aligns with a center of the guideway provided in the bearing section in the closed position or the center of the guideway provided in an adjacent bearing section which is in the "closed" position.

5. The door assembly according to claim 1, further comprising a stabilizing element which, in the open position, is in contact with an internal stabilizing surface of the principal structural section.

6. The door assembly according to claim 5, wherein the stabilizing element includes a roller in contact with the stabilizing surface provided in the adjacent bearing section.

7. The door assembly according to claim 5, wherein the stabilizing element in the end part of the bearing section includes a ball bearing.

8. The door assembly according to claim 1, wherein the mobile assembly mounted in the bearing section is a wheel assembly including at least one roller.

9. The door assembly according to claim 1, wherein the guideway and the guide surface are substantially cylindrical in cross section.

10. The door assembly according to claim 1, wherein the stabilizing element of the bearing section includes a roller.

11. The door assembly according to claim 1, wherein a free end of the plurality of forward movable doors is fitted in a trimming section provided with two juxtaposed seating surfaces which are in contact with opposite surfaces of a countershape of a principal closing section forming part of a door frame.

12. The door assembly according to claim 11, wherein the principal structural section includes a compression spring.

13. The door assembly according to claim 1, wherein the principal structural section is provided with grooves for the installation of mechanisms for the suspension of shelves, lighting, and connection of supplementary display case elements.

14. A door assembly for forward and subsequent lateral displacement of a plurality of forward movable doors, the door assembly comprising:

a plurality of forward movable doors; and at least one load-bearing frame comprising:

a compact linear assembly comprising:

a principal structural section;

at least two mutually forward movable bearing sections fastened to the forward movable doors;

at least two action elements seated in the principal structural section and movable between forward and back positions;

a mobile assembly in each of the bearing sections for transporting the doors along a guide surface of the action elements and a guideway of the bearing section;

two stops provided in the principal structural section for limiting the movement of the action element; and wherein the mobile assembly includes at least one travel wheel mounted between two side plates fixed by means of two flat springs in the bearing section.

15. A free-standing case comprising:

at least one wall of the free-standing case comprising at least two mutually overlapping forward movable surfaces capable of lateral displacement; and at least one load bearing frame which connects individual walls of the case wherein a plane of the load bearing frame is perpendicular to the walls of the case, a linear part of at least one of the load bearing frames is a linear compact assembly, which is parallel with a plane of the mutually forward movable surfaces;

the linear compact assembly comprising:

a principal structural section situated parallel to the plane of the forward movable surfaces, the principal structural section providing a second contact surface for fixing of the forward movable surface in a closed position;

at least two identical action elements each having a constant cross-section along their whole length, freely seated by one of rocking and shifting motion consecutively inside of the principal structural section in a seat, running in the principal structural section, while the principal structural section is in contact with all action elements, and the travel of the action elements is limited by two stops in the principal structural section; and at least two identical mutually forward movable bearing sections, having a constant cross-section along their whole length and firmly connected with the forward movable surfaces, each bearing section including a mobile assembly situated for free motion of the bearing section on a guide surface of each action element, running along the whole length of the action element parallel with the plane of said forward movable surfaces, wherein each bearing section is provided with a guideway running along its whole length enabling the motion of the adjacent forward movable surface in a forwarded displaced position by means of the mobile assembly on the guideway of the bearing section of the other movable surface in a closed position, whereby the guide surface of the said adjacent movable surface is aligned with the guideway of the bearing section of the said other movable surface in the closed position.

16. The free-standing case according to claim 15, wherein the bearing section is provided with a first contact surface which is, in the closed position, in contact with the second contact surface in the principal structural section, while the first contact surface is a projection and the second contact surface is a recess.

17. The free-standing case according to claim 15, wherein the action elements consist of a lever rocking in a seat provided in the principal structural section.

18. The free-standing case according to claim 15, wherein the guideway in the bearing section is opposite the fixed connection of the forward movable surface with the bearing section, while a center of the guide surface after movement of the action element from the first stop in the closed position to the second stop in the open position aligns with a center of the guideway in the bearing section in the closed position.

19. The free-standing case according to claim 15, wherein the bearing section is provided with a stabilizing element which is, in the open position, in contact with a stabilizing surface in the adjacent bearing section which is in the closed position.

20. The free-standing case according to claim 19, wherein the stabilizing element in the bearing section consists of one of a roller, a pulley, and a ball bearing.

21. The free-standing case according to claim 15, wherein the mobile assembly comprises at least one travel wheel mounted between two side plates fixed by means of two flat springs.

22. The free-standing case according to claim 15, wherein the mobile assembly mounted in the bearing section includes a roller.

23. The free-standing case according to claim 15, wherein the guideway and the guide surface are substantially cylindrical in cross section.

24. The free-standing case according to claim 15, wherein a free part of the forward movable surface is fitted in a trimming section provided with two juxtaposed seating surfaces which are in contact with opposite surfaces of a principal closing section having a corresponding shape.

25. The free-standing case according to claim 15, wherein in the principal structural section there is a compression spring.

26. The free-standing case according to claim 15, wherein the principal structural section is provided with grooves for an installation of mechanisms for the suspension of shelves, lighting, and connection of supplementary display case elements.

* * * * *